US008017846B2

(12) United States Patent
Miyajima

(10) Patent No.: US 8,017,846 B2
(45) Date of Patent: Sep. 13, 2011

(54) STRAINER AND SNARE DRUM

(75) Inventor: Hideyuki Miyajima, Seto (JP)

(73) Assignee: Hoshino Gakki Co., Ltd. (JP)

( * ) Notice: Subject to any disclaimer, the term of this patent is extended or adjusted under 35 U.S.C. 154(b) by 0 days.

(21) Appl. No.: 12/489,556

(22) Filed: Jun. 23, 2009

(65) Prior Publication Data

US 2010/0242707 A1 Sep. 30, 2010

(30) Foreign Application Priority Data

Mar. 26, 2009 (JP) ..... 2009-076681

(51) Int. Cl.
*G10D 13/02* (2006.01)

(52) U.S. Cl. ..... 84/415

(58) Field of Classification Search ..... 84/415, 84/417

See application file for complete search history.

(56) References Cited

U.S. PATENT DOCUMENTS

| | | | | |
|---|---|---|---|---|
| 4,787,286 | A | 11/1988 | Okumura | 84/417 |
| 6,846,978 | B2 | 1/2005 | Dorfman et al. | |
| 7,312,389 | B2 | 12/2007 | Okamoto | 84/415 |
| 7,498,501 | B1 | 3/2009 | Hsieh | |
| 2004/0168563 | A1 | 9/2004 | Dorfman et al. | 84/415 |
| 2005/0188818 | A1 | 9/2005 | Okamoto | 84/415 |
| 2006/0213352 | A1* | 9/2006 | Takegawa | 84/415 |
| 2006/0266198 | A1* | 11/2006 | Jeffries et al. | 84/417 |

FOREIGN PATENT DOCUMENTS

| | | |
|---|---|---|
| JP | 4-93889 | 8/1992 |
| JP | 7-39093 | 7/1995 |
| JP | 63-030894 | 2/1998 |
| JP | 63-030895 | 2/1998 |
| JP | 2005-227660 | 8/2005 |
| JP | 2006-065156 | 3/2006 |

OTHER PUBLICATIONS

Japanese Office Action dated Apr. 12, 2011 issued in corresponding Japanese Application No. 2009-076681 (4 pages).

* cited by examiner

*Primary Examiner* — Jianchun Qin
(74) *Attorney, Agent, or Firm* — Ostrolenk Faber LLP

(57) ABSTRACT

A strainer includes a strainer body, a slider to which a cam follower is fixed, a holder to which snare wires are fixed, an operating lever, and a cam that is pivoted through operation of the operating lever. The slider is slid relative to the strainer body by pivoting the cam through operation of the operating lever so that the cam follower moves along the cam surface. The movement distance of the slider linearly changes with respect to an operation angle of the operating lever.

10 Claims, 9 Drawing Sheets

STRAINER AND SNARE DRUM

BACKGROUND OF THE INVENTION

The present invention relates to a strainer that is operated to cause snare wires to contact and separate from a drumhead and to a snare drum.

A snare drum includes a cylindrical shell, a pair of drumheads respectively attached to the upper and lower openings of the shell, snare wires that are provided along the surface of the lower drumhead in a stretched state, and a strainer attached to the outer circumference of the shell. The strainer is used to switch the snare wires between an OFF position, where the wires are separated from the surface of the drumhead, and an ON position, where the wires contact the surface of the drumhead.

As shown in FIGS. 10A and 10B, a typical strainer 100 includes a strainer body 102 having a slide groove 102*a*, a slider 103 slidably supported to the strainer body 102, and a cam 104 pivotably supported to the strainer body 102. The slider 103 includes a cam follower 105 and a holder 108, to which a belt 107 of the snare wires 106 are fixed. A circumferentially extending cam groove 104*a* is formed in the cam 104. An operating lever 104*b* is integrally formed with the cam 104. The slider 103 is attached to the strainer body 102 and the cam 104 with the cam follower 105 passed through the slide groove 102*a* and the cam groove 104*a*.

When the operating lever 104*b* of the strainer 100 is pulled up to pivot the cam 104 counter clockwise as viewed in FIG. 10A (clockwise as viewed in FIG. 10B), the cam follower 105 is moved upward in the slide groove 102*a* while moving in the cam groove 104*a*. Accordingly, the pivoting motion of the cam 104 is converted into linear motion of the cam follower 105, so that the slider 103 is slide upward together with the cam follower 105. When the operating lever 104*b* is pulled up until the cam follower 105 contacts an end of the cam groove 104*a*, the snare wires 106 are switched to the ON position. On the other hand, to switch the snare wires 106 from the ON position to the OFF position, an operation opposite to the operation for switching to the ON position is performed. That is, the operating lever 104*b* is pulled down to pivot the cam 104 clockwise as viewed in FIG. 10A (counterclockwise as viewed in FIG. 10B).

However, the movement speed of the snare wires 106 when switched form the OFF position to the ON position, in other words, the relationship between the operation angle of the operating lever 104*b* and the movement distance of the snare wires 106 is not considered in the conventional strainer 100. In many cases, as shown in FIG. 11, immediately after the snare wires 106 start being pulled up from the OFF position, the movement distance of the snare wires 106 relative to a given operation angle of the operating lever 104*b* is relatively large. Also, immediately before the snare wires 106 reach the ON position, the movement distance of the snare wires 106 relative to a given operation angle of the operating lever 104*b* is relatively small.

In addition, depending on the preference of the player, the position of the snare wires 106 in the up-down direction immediately after the snare wires 106 are switched to the ON position varies. For these reasons, depending on the position of the snare wires 106 immediately after being switched to the ON position, the snare wires 106 hit the drumhead when switched to the ON position, which can produce a relatively loud contact noise. Therefore, during an orchestra performance, if the snare wires 106 are frequently switched between the ON position and the OFF position, the contact noise of the snare wires 106 generated at each switching can damage the atmosphere of the music.

To reduce the contact noise of the snare wires 106, the operating lever 104*b* may be operated slowly so that the snare wires 106 do not hit the drumhead. However, as shown in FIG. 11, the movement speed of the snare wires 106 the conventional strainer 100 is relatively great from the OFF position to immediately before reaching the ON position. Thus, even if the operating lever 104*b* is pulled up slowly, it is very difficult to make the snare wires 106 gently touch the drumhead. It is therefore impossible to eliminate the contact noise of the snare wires 106.

U.S. Pat. No. 6,846,978 discloses a strainer different from that described above. The strainer of the US patent has an operating lever that is operated along a horizontal direction when the snare wires are switched to the ON position or OFF position. However, compared to the strainer 100 illustrated in FIGS. 10A and 10B, the strainer of the US patent requires larger movement of the operating lever when switching the snare wires to the ON position or the OFF position. Also, unlike typical strainers, which have an operating lever moved upward or downward, the operating lever is moved along the horizontal direction. The operation of the strainer of the US patent is therefore troublesome for some players. Further, the movement speed of the snare wires when switched to the ON position or the OFF position is not taken in to consideration.

Further, U.S. Pat. No. 7,498,501 discloses a strainer that includes a cylindrical base, an adjuster assembly, a snare mount, and an operating lever. The adjuster assembly is slidably supported in the base. The snare mount is a part to which the snare wires are attached, and is attached to the lower end of the adjuster assembly. The operating lever is manipulated to switch the position of the snare wires between an ON position and an OFF position, and is coupled to the adjuster assembly with a link mechanism. The strainer further includes an operating knob and a holding mechanism. The operating knob is used to adjust the position of the snare wires in the up-down direction after. The holding mechanism holds the operating knob so that the operating knob is not loosened by vibration of the drum. However, according to the strainer disclosed in the publication, operation of the operating lever causes rigid bodies (parts) forming the link mechanism to slide on and contact each other. This can result in disturbing noises. Further, parts other than the operating knob need to be prepared as parts forming the holding mechanism. Specifically, a friction ring that is frictionally engaged with the lower surface of the operating knob and a compression spring for urging the friction ring so as to press the friction ring against the lower surface of the operating knob need to be prepared. This increases the number of the parts and is likely to raises the manufacturing costs.

SUMMARY OF THE INVENTION

It is an objective of the present invention to provide a strainer and a snare drum that minimize the contact noise when the snare wires contact a drumhead.

To achieve the foregoing objective and in accordance with a first aspect of the present invention, a strainer for a snare drum that switches the position of snare wires between an OFF position separated from a drumhead and an ON position contacting the drumhead is provided. The strainer includes a strainer body, a slider, a holder, an operating lever, and a cam. The strainer body is attached to a shell of the snare drum. The slider is supported to the strainer to be slidable. A cam follower is fixed to the slider. The holder is provided in the slider. The snare wires are fixed to the holder. The operating lever is operated when the position of the snare wires is switched. The cam pivotably is supported to the strainer body and has a cam surface contacting the cam follower. The cam is pivoted by operation of the operating lever. The slider is slid relative to the strainer body by pivoting the cam through operation of the operating lever so that the cam follower moves along the cam surface. The movement distance of the slider linearly changes with respect to an operation angle of the operating lever.

In accordance with a second aspect of the present invention, a snare drum is provided that includes a cylindrical shell, a pair of drumheads each attached to one of the upper and lower opening ends of the shell, snare wires provided along the lower drumhead in a stretched state, and a strainer that is attached to an outer circumference of the shell and switches the position of the snare wires between an OFF position separated from the drumhead and an ON position contacting the drumhead. The strainer includes a strainer body, a strainer body, a slider, a holder, an operating lever, and a cam. The strainer body is attached to a shell of the snare drum. The slider is supported to the strainer to be slidable. A cam follower is fixed to the slider. The holder is provided in the slider. The snare wires are fixed to the holder. The operating lever is operated when the position of the snare wires is switched. The cam pivotably is supported to the strainer body and has a cam surface contacting the cam follower, the cam being pivoted by operation of the operating lever. The slider is slid relative to the strainer body by pivoting the cam through operation of the operating lever so that the cam follower moves along the cam surface. The movement distance of the slider linearly changes with respect to an operation angle of the operating lever.

DETAILED DESCRIPTION OF THE PREFERRED EMBODIMENTS

A strainer according to one embodiment of the present invention will now be described with reference to FIGS. 1 to 9.

Figure 1:
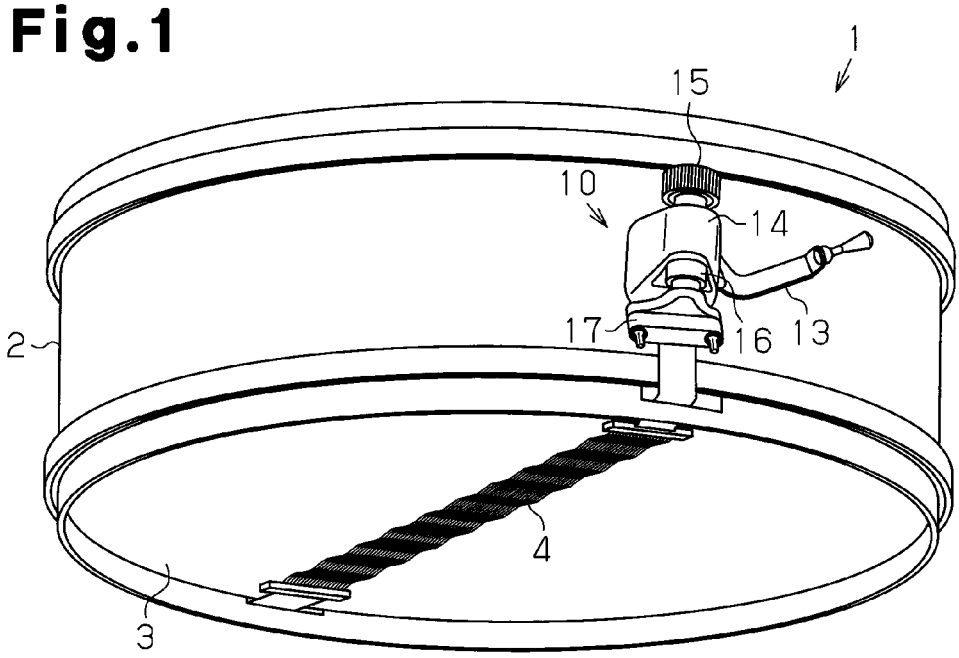
FIG. 1 is a perspective view as seen from below, showing a snare drum to which a strainer according to one embodiment of the present embodiment is attached.

As shown in FIG. 1, a snare drum 1 includes a cylindrical shell 2, a pair of drumheads 3, snare wires 4, and a strainer 10. The drumheads 3 are respectively attached to upper and lower openings of the shell 2. The snare wires 4 are provided along the surface of the lower drumhead 3 in a stretched state. The strainer 10 is attached to the outer circumferential surface of the shell 2. A butt (not shown) is attached to the outer circumferential surface of the shell 2 at a position opposite to the strainer 10. The snare wires 4 are supported by the butt and the strainer 10 such that the snare wires 4 can be brought into contact with and separated from the surface of the drumhead 3, and that the tension of the snare wires 4 is adjustable.

Figure 2:
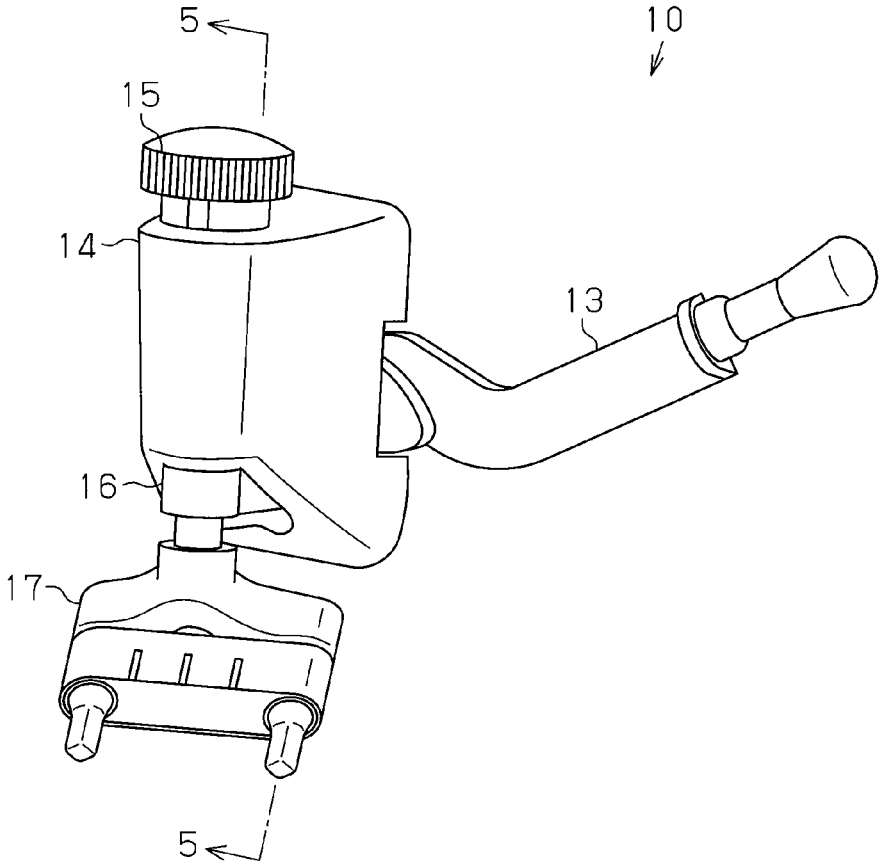
FIG. 2 is a perspective view of the strainer.
Figure 3:
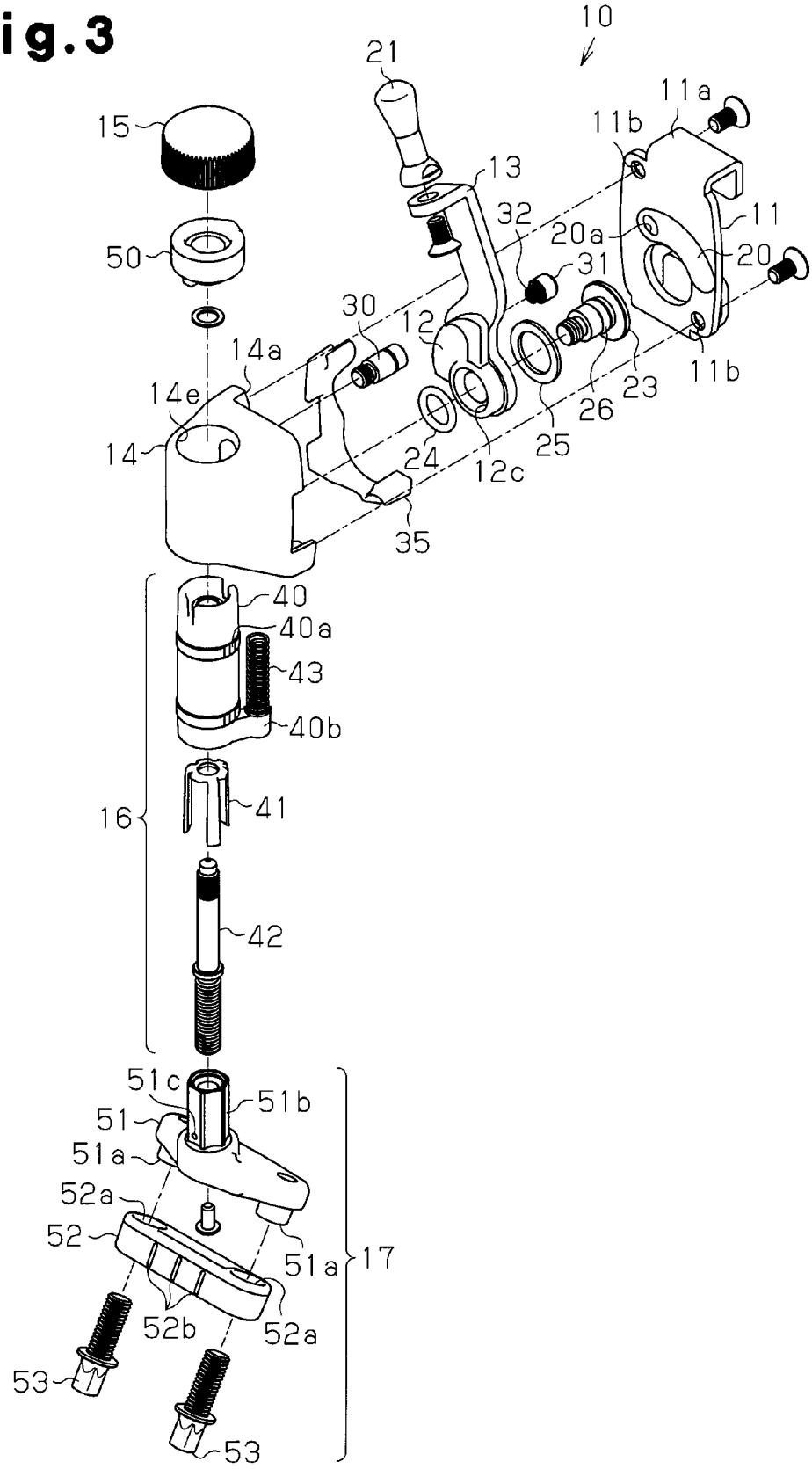
FIG. 3 is an exploded perspective view of the strainer.

As shown in FIGS. 2 and 3, the strainer 10 includes a base plate 11, a cam 12, an operating lever 13, a strainer body 14, an operating knob 15, a slider 16, and a holder 17. A bracket 11*a* is provided at each of the upper end and lower end of the base plate 11. Each bracket 11*a* is formed by bending one end of the base plate 11 into an L-shape. A threaded hole is formed in each bracket 11*a*. A screw for fixing the strainer 10 to the shell 2 is threaded to the threaded hole of each bracket 11*a*.

Figure 6:
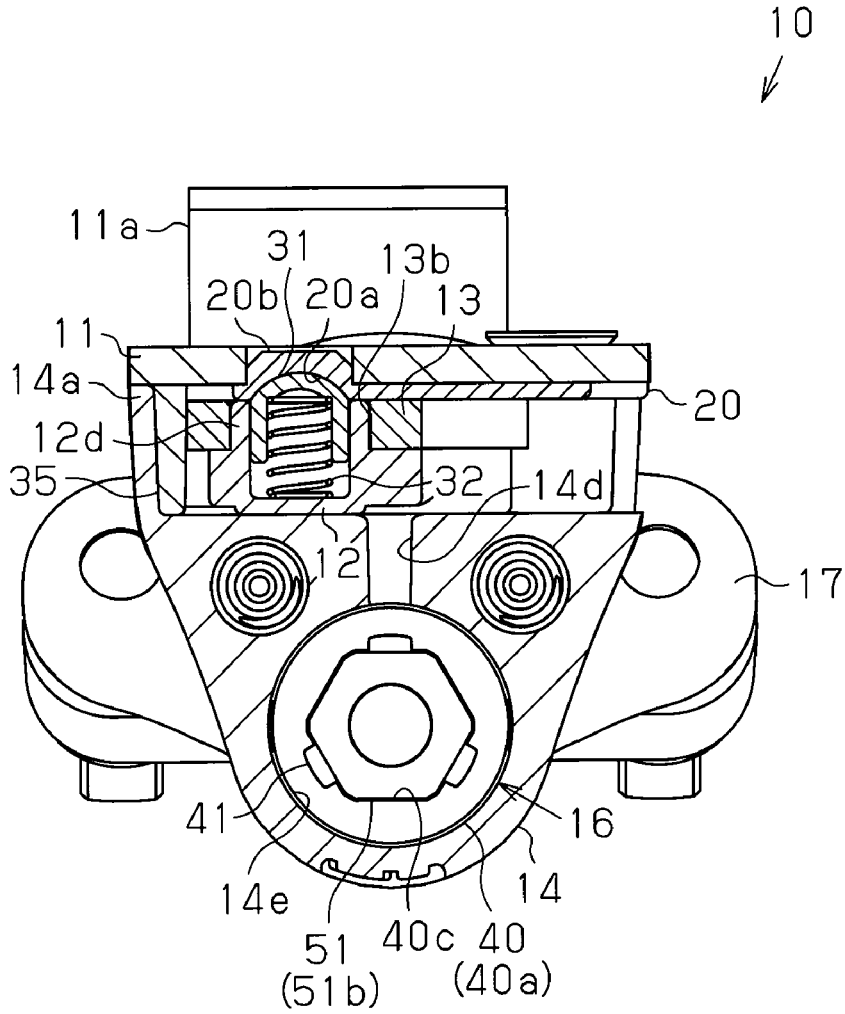
FIG. 6 is a cross-sectional view illustrating the internal structure of the strainer when the snare wires are at the ON position.
Figure 7:
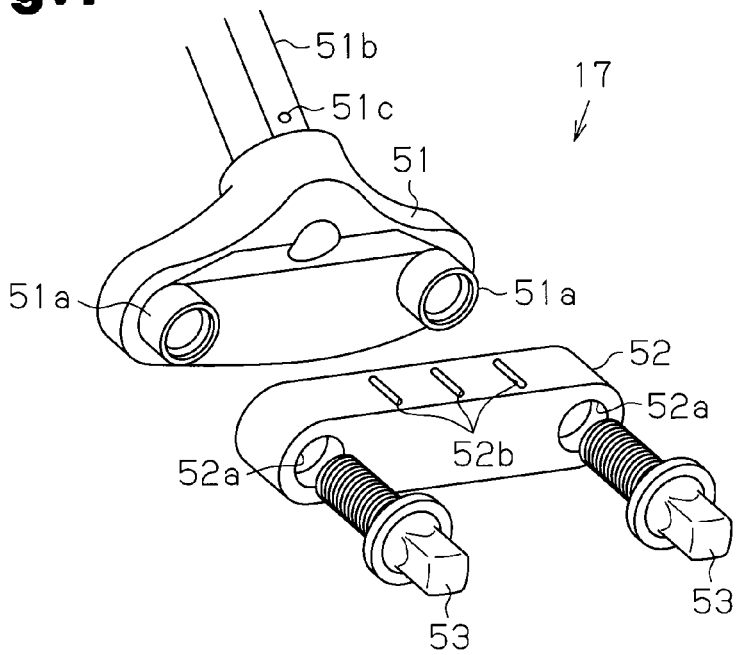
FIG. 7 is a perspective view of the holder.

As shown in FIGS. 3 and 6, a resin spacer 20 is fixed to a surface of the base plate 11 that is opposite to the brackets 11*a*. The spacer 20 is a molded product extending arcuately. The spacer 20 has a recess 20*a* formed by a spherical indentation on one side, and a projection 20*b* at a position on the other surface at a position corresponding to the recess 20*a*. The spacer 20 is fixed to the base plate 11 with the projection 20*b* fitted in a hole of the base plate 11. The base plate 11 has through holes 11*b*, which are used to fasten the base plate 11 to the strainer body 14, in diagonal corners.

Figure 4B:
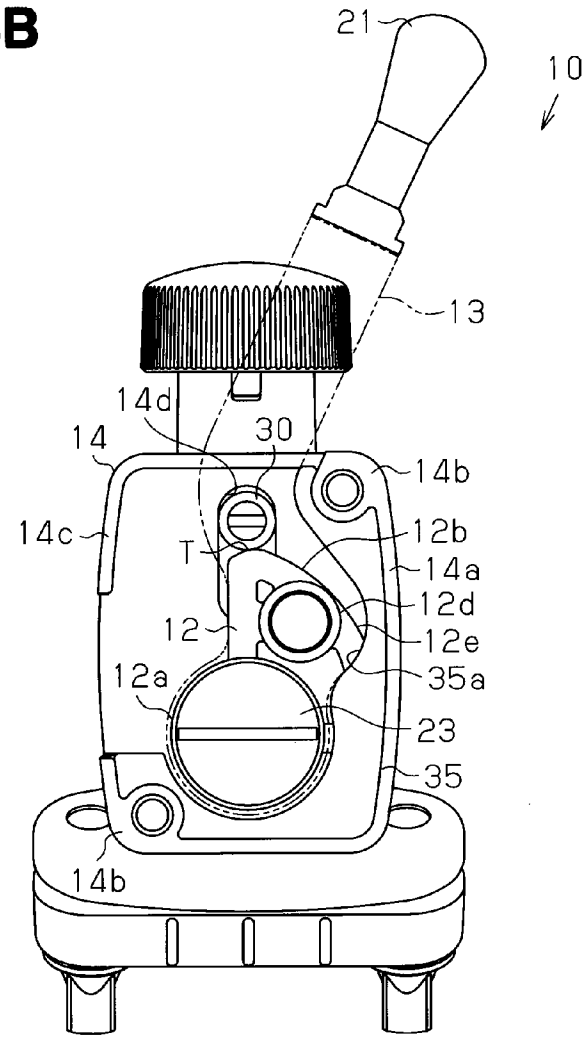
FIG. 4B is a plan view illustrating the internal structure of the strainer, when snare wires are at the OFF position.
Figure 4A:
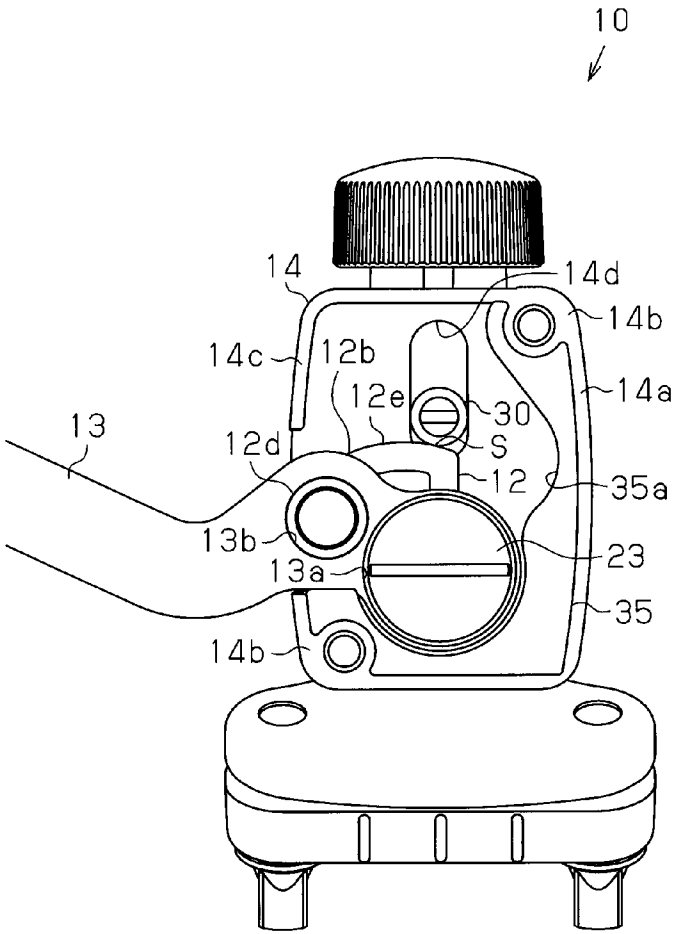
FIG. 4A is a plan view illustrating the internal structure of the strainer, when snare wires are at the OFF position.

The strainer body 14 is mounted on a surface of the base plate 11 that is opposite to the brackets 11*a*. The strainer body 14 includes a case portion 14*a*, which has a space surrounded by four walls. The strainer body 14 accommodates the cam 12 and the operating lever 13 in the space of the case portion 14*a*. Also, as shown in FIGS. 4A and 4B, fixing portions 14*b* are provided in diagonal corners of the case portion 14*a*. Each fixing portion 14*b* has a threaded hole. A screw for fixing the base plate 11 to the strainer body 14 is threaded to each fixing portions 14*b* of the case portion 14*a*.

Together with the operating lever 13, the cam 12 attached to the strainer body 14 is accommodated in the case portion 14*a*. When bringing the snare wires 4 into contact with or separating the snare wires 4 from the drumhead 3, the operating lever 13 is operated to switch the snare wires 4 between an OFF position, where the snare wires 4 are away from the drumhead 3, and an ON position, where the snare wires 4 contact the drumhead 3. The operating lever 13 extends outward from the case portion 14*a* through an opening 14*c*. An operating knob 21 is attached to the distal end of the operating lever 13 by means of a screw. Two fixing holes 13*a*, 13*b* are formed in the proximal portion of the operating lever 13. The fixing holes 13*a*, 13*b* are used to fix the lever 13 to the cam 12.

The cam 12 includes a fixing portion 12*a*, which is fixed to the first fixing hole 13*a* of the operating lever 13, and a cam portion 12*b*, which is fixed to the second fixing hole 13*b* of the operating lever 13. The fixing portion 12*a* has a shaft hole 12*c* at a position that corresponds to the first fixing hole 13*a* of the operating lever 13 (see FIG. 3). The cam portion 12*b* has a cylindrical projection 12*d* at a position that corresponds to the second fixing hole 13*b* of the operating lever 13 (see FIG. 6). The cam 12 is fixed to the proximal portion of the operating lever 13 in the state where the shaft hole 12*c* is aligned with the first fixing hole 13*a* of the operating lever 13, and the projection 12*d* is inserted in the second fixing hole 13*b* of the operating lever 13.

The cam 12 is supported by a bolt 23 to be pivotable with respect to the strainer body 14 together with the operating lever 13. To make the pivoting torque of the operating lever 13 have an appropriate value, an O ring 24 is placed between the cam 12 and the strainer body 14. Also, a washer 25 and an O-ring 26 are placed between the proximal portion of the operating lever 13 and the head of the bolt 23 (see FIG. 3).

The cam 12 is designed such that the movement distance of the snare wires 4 linearly changes with respect to the operation angle of the operating lever 13. Specifically, the cam 12 has a cam surface 12*e*, which extends along a spiral about the pivot center of the cam 12. More specifically, the cam surface 12*e* has a leading end S, which contacts a cam follower 30 discussed below when the operating lever 13 is pulled down as shown in FIG. 4A, and a trailing end T, which contacts the cam follower 30 when the operating lever 13 is pulled up as shown in FIG. 4B. In the vicinity of the trailing end T, the cam surface 12*e* extends along an arc about the pivot center of the cam 12, or along an arc about a center coinciding with the axis of the bolt 23. In the present embodiment, the operation for pulling up the operating lever 13 is an ON operation for switching the position of the snare wires 4 to the ON position. The operation for pulling down the operating lever 13 is an OFF operation for switching the position of the snare wires 4 to the OFF position.

As shown in FIG. 6, the cam 12 has a locking mechanism for holding the operating lever 13 when the lever 13 is pulled up. The locking mechanism includes a locking pin 31 accommodated in the projection 12*d*, the recess 20*a* of the spacer 20, and a compression coil spring 32, which urges the locking pin 31 toward the recess 20*a*. The distal end of the locking pin 31 is formed to be spherical so as to conform to the shape of the recess 20*a*. The position of the recess 20*a* is determined such that the locking pin 31 is engaged with the recess 20*a* at the time when the snare wire 4 is switched to the ON position. That is, when the locking mechanism operates, the locking pin 31 is engaged with the recess 20*a*, so that the snare wires 4 is held at the ON position.

As shown in FIGS. 4A and 4B, a stopper 35 is provided in the case portion 14*a*. The stopper 35 prevents the pulled up operating lever 13 from being further pivoted, more specifically, from being pivoted clockwise from the position shown in FIG. 4B. The stopper 35 is made of an elastic material such as rubber. The stopper 35 has a support surface 35*a*, which supports the cam 12 and the operating lever 13 at each of the positions shown in FIGS. 4A and 4B. The support surface 35*a* has the same shape as the proximal portion of the operating lever 13 and a part of the cam 12. The stopper 35 is attached such that the support surface 35*a* faces the operating lever 13 and the cam 12, and that the surface opposite to the operating lever 13 closely contacts the inner surface of the case portion 14*a*. A slide groove 14*d* extending in the up-down direction is formed in a center of an upper portion of the case portion 14*a*. The length of the slide groove 14*d* is determined according to the movement distance of the cam follower 30, which is moved linearly by pivoting motion of the cam 12.

Figure 5:
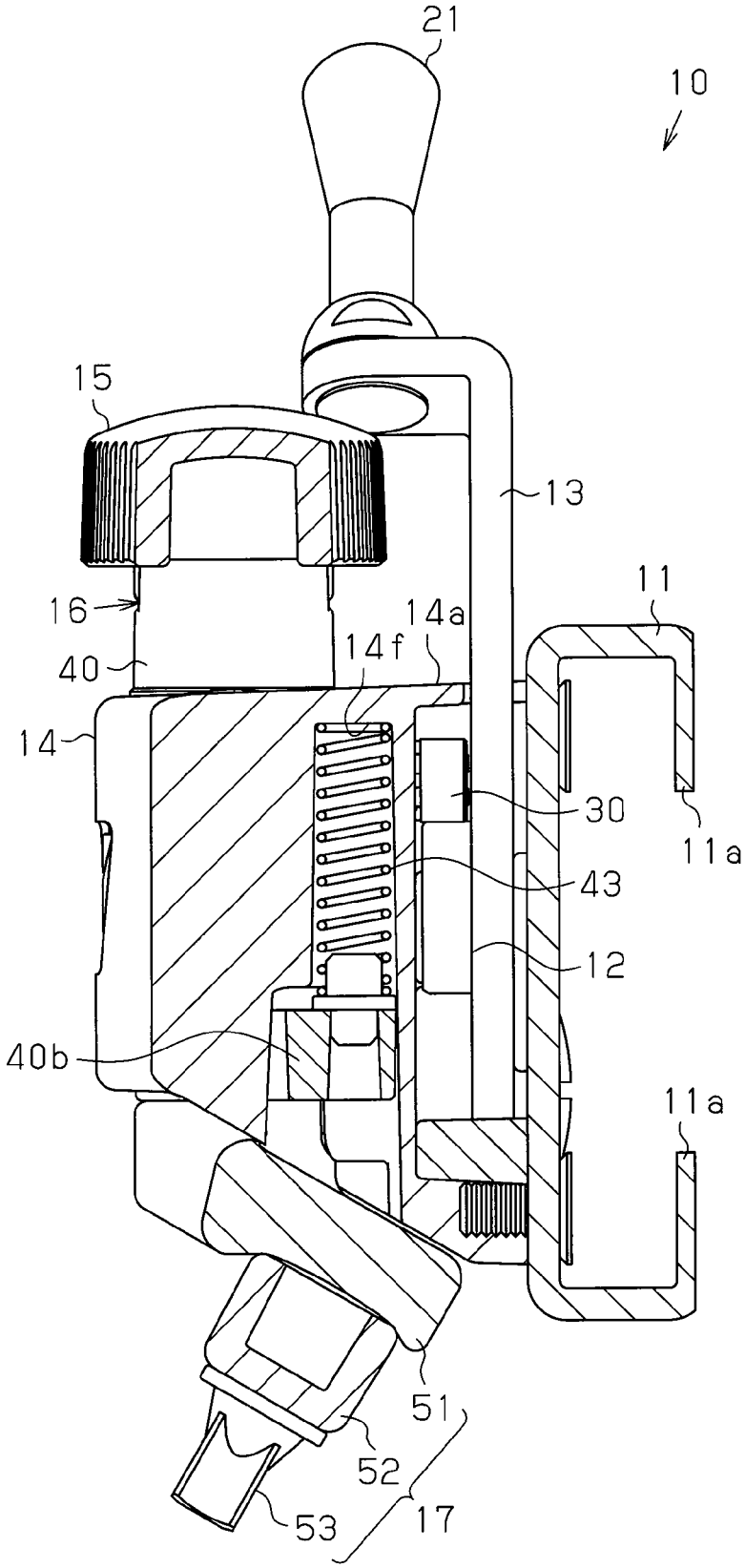
FIG. 5 is a cross-sectional view taken along line 5-5 of FIG. 2.

As shown in FIGS. 3, 5, and 6, the strainer body 14 supports a slider 16, which moves linearly together with the cam follower 30. The slider 16 includes a slider body 40, a slider guide 41, a slider bolt 42, a spring 43 serving as urging means. These components are assembled to be an integral body. The strainer body 14 has a support hole 14*e* for slidably supporting the slider body 40. The slide groove 14*d* extends from the support hole 14*e* to the inner space of the case portion 14*a*. The strainer body 14 also has an accommodation hole 14*f* for accommodating the spring 43. The accommodation hole 14*f* is a narrow hole extending in the up-down direction, and is located in the vicinity of the case portion 14*a*.

The slider body 40 includes a substantially cylindrical first portion 40*a* and a second portion 40*b*, which holds the spring 43. The cam follower 30 is fixed to the first portion 40*a* of the slider 40. The cam follower 30 is a component that contacts the cam surface 12*e* of the cam 12, and is formed to have a columnar shape. Pivoting motion of the cam 12 is converted to linear motion of the slider 16 by the cam follower 30. That is, pivoting motion of the cam 12 causes the slider body 40, to which the cam follower 30 is fixed, is moved linearly in the up-down direction within the support hole 14*e*. The spring 43 is accommodated in the accommodation hole 14*f* of the strainer body 14 in a compressed state. The compressed spring 43 urges the slider body 40 downward as viewed in FIG. 5. The downward direction refers to the direction along which the snare wires 4 are separated from the drumhead 3.

The slider bolt 42 having a thread at each end is passed through the first portion 40*a* of the slider body 40 from below, with the slider guide 41 placed in between. A cap 50 formed by an elastic member is fixed to the upper end of the first portion 40*a* of the slider body 40. The operating knob 15, which has a threaded hole, is attached to the outer circumference of the cap 50. The operating knob 15 is used to fine adjust the position of the snare wires 4 in the up-down direction after the snare wires 4 are switched to the ON position. The upper end of the slider bolt 42 is passed through the through hole of the cap 50, and is threaded to the threaded hole of the operating knob 15. The slider bolt 42 can be pivoted about the axis together with the operating knob 15.

Figure 8:
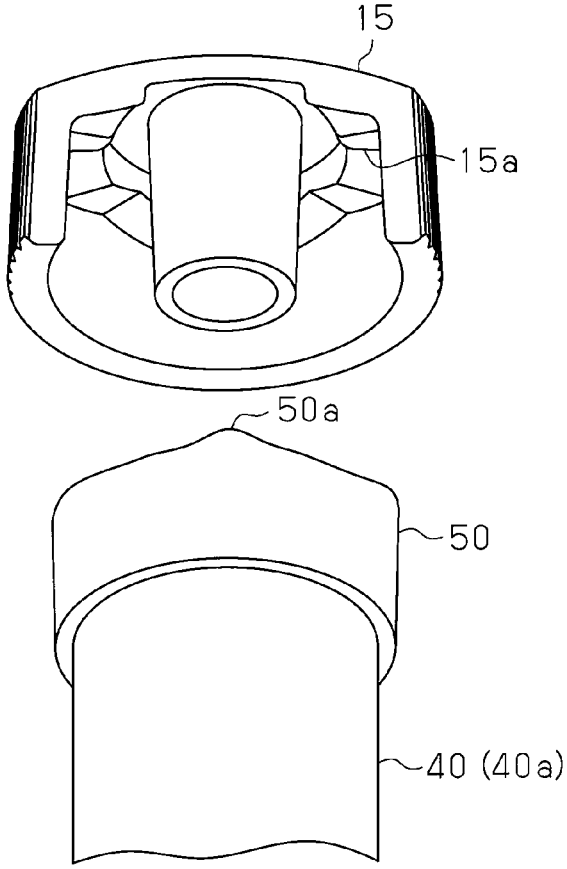
FIG. 8 is a perspective view of a holding mechanism.

As shown in FIGS. 3 and 8, the holder 17 is supported at the lower end of the first portion 40*a* of the slider body 40. The holder 17 includes a clamp holder 51 threaded to the slider bolt 42, a clamp cover 52 used to fix the snare wires 4 together with the clamp holder 51, and a pair of bolts 53 for fixing the clamp cover 52 to the clamp holder 51. A pair of guides 51*a* are provided on the lower surface of the clamp holder 51. Each guide 51*a* projects toward the clamp cover 52 and has a threaded hole. The clamp cover 52 has a pair of guide holes 52*a* for receiving the guides 51*a*. The bolts 53 are inserted in the guide holes 52*a* and then threaded to the threaded holes of the guides 51*a*, so as to fix the clamp cover 52 to the clamp holder 51, so that the snare wires 4 are held between the clamp cover 52 and the clamp holder 51. Also, three thin grooves 52*b* are carved in the clamp cover 52. The thin grooves 52*b* are positioning means for determining the position of the snare wires 4 relative to the holder 17 in the widthwise direction. One of the grooves 52*b* is located in the center of the clamp cover 52, and the other grooves 52*b* are located on both sides of the center groove 52*b*.

A post 51*b* having a threaded hole is formed in a center of the clamp holder 51. The post 51*b* has a regular hexagonal cross-section. The post 51*b* of the clamp holder 51 is threaded to the lower end of the slider bolt 42 and inserted into the first portion 40*a* of the slider body 40 from below. Pivoting motion of the clamp holder 51 relative to the slider body 40 is restricted by a restriction portion 40*c* provided in the first portion 40*a* (see FIG. 6). In the present embodiment, the restriction portion 40*c* is formed by a wall surface having a hexagonal cross-section in the first portion 40*a*. That is, the clamp holder 51 is held so as not to pivot with the slider bolt 42 when slider bolt 42 is pivoted based on operation of the operating knob 15. Accordingly, when the operating knob 15 is pivoted, the slider bolt 42 pivots, but the clamp holder 51 does not pivot. Thus, the amount of threading of the slider bolt 42 to the clamp holder 51 is changed, so that the position of the clamp holder 51 in the up-down direction relative to the slider body 40 is adjusted. In this manner, the strainer 10 includes a position adjustment mechanism that fine adjusts the position of the snare wires 4 in the up-down direction at the ON position based on operation of the operating knob 15. A mark 51*c* is provided on the post 51*b* of the clamp holder 51. The mark 51*c* indicates the position of the clamp holder 51 in the up-down direction relative to the slider body 40. In the present embodiment, the clamp holder 51 is supported to be slidable between an upper limit position and a lower limit position by operation of the operating knob 15. The position of the mark 51*c* is determined such that, when the clamp holder 51 is at the upper limit position, the mark 51*c* is concealed by the slider body 40, and that when the clamp holder 51 is at the lower limit position, the mark 51*c* is located below the lower end of the slider body 40 by a predetermined distance.

As shown in FIGS. 3 and 8, the strainer 10 has a holding mechanism that holds the slider bolt 42 so that the slider bolt 42 will not be loosened after being threaded to the clamp holder 51. The holding mechanism includes a first step 15*a* serving as an engaging portion formed inside the operating knob 15, and a second step 50*a* serving as an engagement portion formed on the upper surface of the cap 50. Engagement of the first step 15*a* of the operating knob 15 with the second step 50*a* of the cap 50 restricts pivoting motion of the operating knob 15. This also restricts pivoting motion of the slider bolt 42 threaded to the operating knob 15.

The operation of the strainer 10 will now be described with reference to FIGS. 4 and 9.

Figure 9:
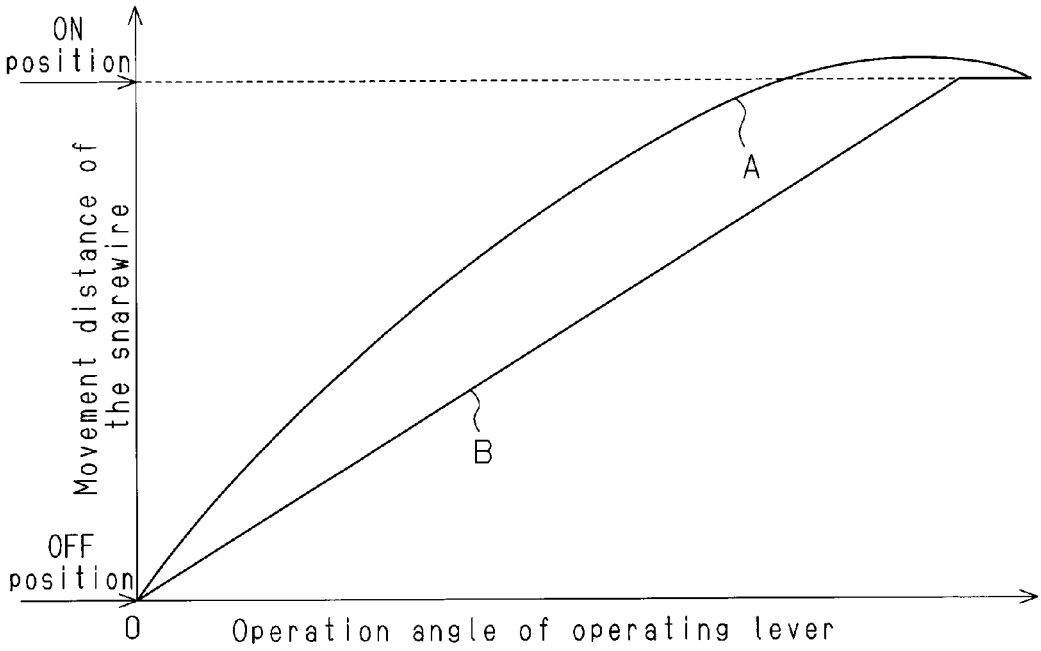
FIG. 9 is a graph showing the comparison between the strainer of the embodiment and a conventional strainer in terms of the relationship between the operation angle of operating levers and movement distance of snare wires.
Figure 10A:
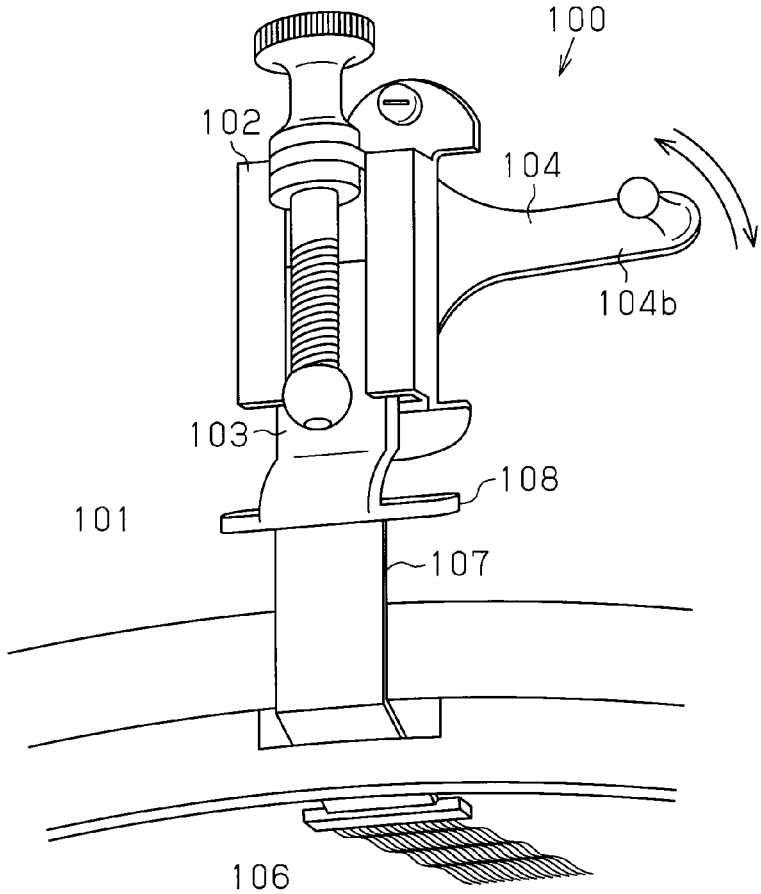
Fig.10A(Prior Art)
FIG. 10A is a perspective view illustrating a conventional strainer as seen from the front.
Figure 10B:
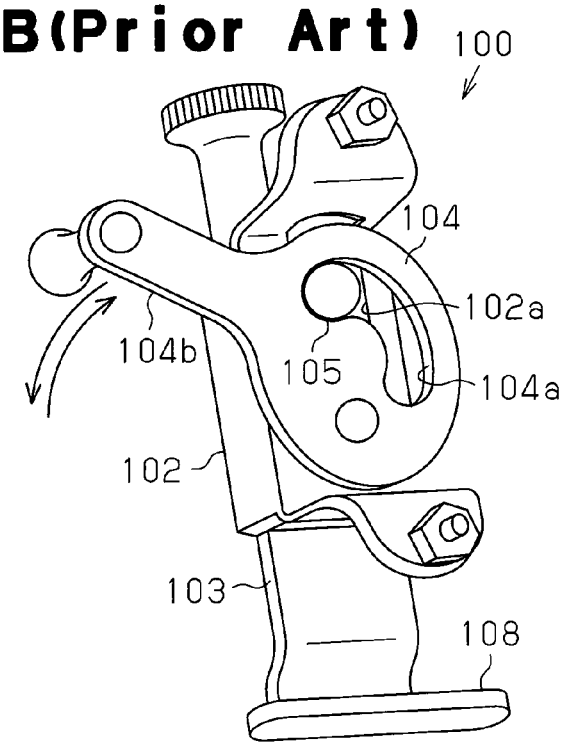
Fig.10B(Prior Art)
FIG. 10B is a perspective view illustrating the conventional strainer as seen from the back.
Figure 11:
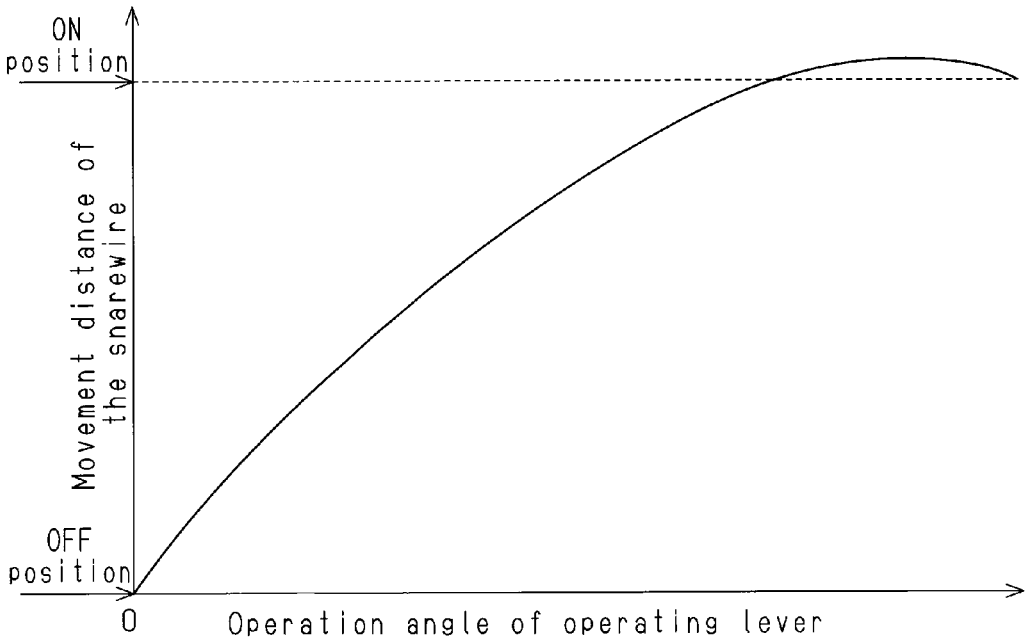
Fig.11 (Prior Art)
FIG. 11 is a graph showing the relationship between the operation angle of the operating lever and the movement distance of the snare wires.

In FIG. 9, curved line A shows the relationship between the operation angle of the operating lever and the movement distance of the snare wires in a conventional strainer. Straight line B shows the relationship between the operation angle of the operating lever 13 and the movement distance of the snare wires 4 in the strainer 10 according to the present embodiment.

As described above, in the conventional strainer, immediately after the snare wires start being pulled up from the OFF position, the movement distance of the snare wires in relation to a given operation angle of the operating lever is relatively large as indicated by curved line A. Also, immediately before the snare wires reach the ON position, the movement distance of the snare wires in relation to a given operation angle of the operating lever is relatively small. That is, in this case, the movement speed of the snare wires in the vicinity of the OFF position is greater than that in the vicinity of the ON position. In contrast, in the strainer 10 according to the present embodiment, the movement distance of the snare wires 4 linearly changes with respect to the operation angle of the operating lever 13.

Specifically, as shown in FIG. 4A, the snare wires 4 are at the OFF position in a state where the operating lever 13 has been pulled down. At this time, the cam follower 30 is at the lower end of the slide groove 14*d*, and contacts the leading end S of the cam surface 12*e* of the cam 12. When the operating lever 13 is being pulled up, the cam 12 is pivoted clockwise as viewed in FIG. 4A. This causes the cam follower 30 to move on the cam surface 12*e* toward the trailing end T, while moving linearly toward the upper end of the slide groove 14*d*. In this manner, until the snare wires 4 are switched to the ON position from the OFF position, the cam follower 30 slides on the cam surface 12*e* extending spirally about the pivot center of the cam 12 (hereinafter, referred to as a first slide region). As a result, the cam follower 30 moves within the slide groove 14*d* in a uniform linear motion, and the slider 16 also moves within the support hole 14*e* in a uniform linear motion. Therefore, as shown in FIG. 9, when being switched from the OFF position to the ON position, the snare wires 4 moves in a uniform linear motion at a lower speed than the conventional strainer. That is, when being switched from the OFF position to the ON position, the movement distance of the snare wires 4 linearly changes with respect to the operation angle of the operating lever 13.

As shown in FIG. 4B, the snare wires 4 are arranged at the ON position when the operating lever 13 has been pulled up. At this time, the cam follower 30 is located at the upper end of the slide groove 14*d*. After the snare wires 4 reach the ON position, the cam 12 is slightly pivoted clockwise by operation of the operating lever 13. At this time, the cam follower 30 finishes sliding in the first slide region, and slides on the cam surface 12*e* that extends along an arc about the pivot center of the cam 12 (hereinafter, referred to as a second slide region). While moving within the second slide region of the cam surface 12*e*, the cam follower 30 does not move in the slide groove 14*d* but remains unmoved at the upper end of the slide groove 14*d*. At this time, the slider 16, to which the cam follower 30 is fixed, remains unmoved. That is, the operating lever 13 is not pulled down by the tension of the snare wires 4, and the cam 12 is not pivoted counterclockwise. Thus, the snare wires 4 do not separate from the drumhead 3, but are held at the ON position.

The present embodiment has the following advantages.

(1) The cam 12 is designed such that the movement distance of the snare wires 4 linearly changes with respect to the operation angle of the operating lever 13. This configuration allows the slider 16 to move in a uniform linear motion in relation to the operation angle of the operating lever 13 in a period during which the snare wires 4 are switched from the OFF position to the ON position. This prevents the snare wires 4 from hitting the drumhead 3 when the snare wires 4 slide together with the slider 16. Therefore, contact noise produced by the snare wires 4 hitting the drumhead 3 is reduced.

(2) The cam 12 has a cam surface 12*e*, which extends along a spiral about the pivot center of the cam 12. In this configuration, the cam follower 30 moves in a uniform linear motion by sliding on the spirally extending cam surface 12*e*. Accordingly, the slider 16, to which the cam follower 30 is fixed, moves in a uniform linear motion in relation to the operation angle of the operating lever 13.

(3) The cam surface 12*e* has the leading end S, which contacts the cam follower 30 when the operating lever 13 is pulled down, and the trailing end T, which contacts the cam follower 30 when the operating lever 13 is pulled up. In the vicinity of the trailing end T, the cam surface 12*e* extends along an arc about the pivot center of the cam 12, or along an arc about a center coinciding with the axis of the bolt 23. In a typical strainer, the snare wires are the closest to the drumhead immediately before reaching the ON position, and the snare wires are moved slightly away from the closest position when at the ON position. Therefore, the snare wires are likely to hit the drumhead, and contact noise is likely to be loud. In contrast, according to the present invention, the cam follower 30 does not move when sliding on an end portion of the arcuately extending cam surface 12*e*, so that the slider 16, to which the cam follower 30 is fixed, does not move. That is, the operation lever 13 is not pulled back to the prior position by the tension of the snare wires 4. Thus, the snare wires 4 are not brought close to the drumhead 3 more than necessary. Therefore, the snare wires 4 are less likely to hit the drumhead 3, and the contact noise is reduced.

(4) The cam 12 has the locking mechanism for holding the operating lever 13 when the lever 13 is pulled up. In this configuration, the locking mechanism maintains the position of the operating lever 13, thereby reliably holding the snare wires 4 at the ON position. During a performance, the operating lever 13 is prevented from being erroneously switched from the ON position to the OFF position due to erroneous operation or vibration.

(5) The lock mechanism includes the locking pin 31 accommodated in the projection 12*d*, the recess 20*a* of the spacer 20, and the compression coil spring 32, which urges the locking pin 31 toward the recess 20*a*. Accordingly, the locking pin 31 is engaged with the recess 20*a*, so that the position of the operating lever 13 is maintained. At this time, the locking pin 31 is urged by the compression coil spring 32 arranged between the locking pin 31 and the cam 12. This enhances the crisp feel, or clicking sensation, generated when the locking pin 31 is fitted in the recess 20*a*. Thus, when sensing the clicking sensation through the operating lever 13, the player becomes aware that the snare wires 4 have been switched to the ON position.

(6) The compressed spring 43 urges the snare wires 4 away from the drumhead 3. Thus, even if the drumhead 3 on which the snare wires 4 are provided in a stretched state is made face upward, the snare wires 4 can be held at the OFF position. This facilitates the attachment of the snare wires 4 to the strainer 10. Since the urging force of the spring 43 switches the snare wires 4 to the OFF position, the shape of the cam 12 can be simplified. This allows the size of the strainer 10 to be reduced.

(7) The strainer 10 includes a position adjustment mechanism that fine adjusts the position of the snare wires 4 in the up-down direction at the ON position. Thus, after the position of the snare wires 4 is switched to the ON position, the position of the snare wires 4 in the up-down direction at the ON position can be fine adjusted by operating the operating knob 15. That is, the contact pressure of the snare wires 4 applied to the drumhead 3 can be fine adjusted, thereby adjusting the resonance of the snare wires 4.

(8) The strainer 10 has the holding mechanism that holds the slider bolt 42 so that the slider bolt 42 is not loosened after being threaded to the clamp holder 51. Since this configuration holds the position of the snare wires 4 in the up-down direction, the contact pressure of the snare wires 4 onto the drumhead 3 is prevented from lowering. Thus, the resonance of the snare wires 4 are maintained.

(9) The holding mechanism includes the first step 15*a* formed inside the operating knob 15, and the second step 50*a* formed on the upper surface of the cap 50. Since the first step 15*a* and the second step 50*a* engage with each other, pivoting motion of the slider bolt 42 about the axis caused by operation of the operating knob 15 is restricted. Specifically, since the cap 50 is fixed to the upper end of the slider body 40, the second step 50*a* formed of convex portion is pressed by the operating knob 15 and the upper end of the slider body 40 to restrict pivoting motion of the operating knob 15. Thus, it is possible to hold the slider bolt 42 so that the slider bolt 42 is not loosened after being threaded to the clamp holder 51. Therefore, since the amount of threading of the slider bolt 42 with the clamp holder 51 is maintained, the position of the snare wires 4 in the up-down direction can be maintained. By using the cap 50, which is made by an elastic member, the crisp feel, or clicking sensation, generated when the first step 15*a* is engaged with the second step 50*a* is enhanced. Thus, when sensing the clicking sensation through the operating knob 15, the player becomes aware that the position of the snare wires 4 in the up-down direction has been adjusted.

(10) The guides 51*a* are provided on the lower surface of the clamp holder 51. Each guide 51*a* projects toward the clamp cover 52 and has a threaded hole. When the clamp cover 52 is mounted to the clamp holder 51, the bolts 53, which are inserted in the guide holes 52*a* of the clamp cover 52, are concealed by the guides 51*a* of the clamp holder 51. This prevents strings and tapes of the snare wires 4 from tangling with bolts 53.

(11) The cam 12 is fixed to the proximal portion of the operating lever 13. Since the operating lever 13 is directly fixed to the cam 12 in this manner, a drawback of the structure in which an operating lever is coupled to a cam with a link mechanism in between is prevented. That is, it is possible to prevent disturbing noises from being generated due to sliding and contacting of rigid bodies (parts) of such a link mechanism. Also, since the holding mechanism of the strainer 10 is formed by two parts, which are the operating knob 15 and the cap 50, the number of the parts is less than the parts of a conventional strainer having a holding mechanism formed by an operating knob, a frictional ring, and a compression spring. It is thus possible to reduce the manufacturing costs.

The present embodiment may be modified as follows.

In the present embodiment, only the second slide region may be omitted from the cam surface 12*e*, which has the first and second slide regions. That is, the entire area of the cam surface 12*e* from the leading end to the trailing end may be formed to extend along a spiral about the pivot center of the cam 12.

In the present embodiment, the locking mechanism for holding the position of the operating lever 13 may be omitted.

In the present embodiment, the positional relationship between the locking pin 31 and the recess 20*a*, which form the locking mechanism, may be reversed. That is, a locking pin may be provided on the spacer 20, and a recess may be formed in the cam 12.

In the present embodiment, the compression coil spring may be omitted from the locking mechanism.

In the present embodiment, the position adjustment mechanism for fine adjusting the snare wires 4 in the up-down direction may be omitted.

In the present embodiment, the holding mechanism for holding the slider bolt 42 so that the slider bolt 42 is not loosened after being threaded to the clamp holder 51 may be omitted.

In the present embodiment, the cap 50 made by an elastic member may be replaced by an operating knob 15 made by an elastic member. Alternatively, both of the cap 50 and the operating knob 15 may be formed by elastic members.

In the present embodiment, the compression coil spring 32 and the spring 43, which function as urging means, may be replaced by elastic members such as leaf springs.

The invention claimed is:

1. A strainer for a snare drum having a shell, the strainer switching a position of snare wires between an OFF position separated from a drumhead and an ON position contacting the drumhead, the strainer comprising:

a strainer body attached to the shell of the snare drum;

a slider that is supported to the strainer so as to be slidable;

a cam follower fixed to the slider;

a holder provided on the slider and configured to affix the snare wires;

an operating lever positioned and configured to be operated so as to switch the position of the snare wires; and a cam pivotably supported on the strainer body and including a cam surface contacting the cam follower, the cam being positioned and configured to be pivoted by operation of the operating lever, wherein the slider is slid relative to the strainer body by the pivoting of the cam caused by operation of the operating lever so that the cam follower moves along the cam surface, wherein the cam surface extends spirally about a pivot center of the cam, and wherein a movement distance of the slider changes linearly with respect to an operation angle of the operating lever.

2. The strainer according to claim 1, wherein the cam surface has a leading end contacting the slider when the snare wires are at the OFF position, and a trailing end contacting the slider when the snare wires are at the ON position, and wherein a part of the cam surface in the vicinity of the trailing end extends along an arc about a pivot center of the cam.

3. The strainer according to claim 1, further comprising a locking mechanism positioned and configured to maintain the position of the operation lever when the snare wires are at the ON position.

4. The strainer according to claim 3, further comprising a base plate positioned and configured to fix the strainer body to the shell, wherein the locking mechanism includes a locking pin provided in the cam, a recess formed in the base plate, and an urging member, wherein the locking pin is engaged with the recess, and the urging member is located between the locking pin and the cam.

5. The strainer according to claim 1, further comprising an urging member located between the strainer body and the slider so that the urging member urges the slider in such a direction that the snare wires are moved away from the drumhead.

6. The strainer according to claim 1, further comprising:

a position adjustment mechanism including an operating knob positioned and configured to adjust the position of the snare wires in an up-down direction when the snare wires are at the ON position; and a holding mechanism positioned and configured to maintain the position of the snare wires in the up-down direction, wherein the holding mechanism includes:

an engaging portion provided in one of the operating knob and the slider; and an engagement portion provided in the other one of the operating knob and the slider, the engagement portion being engaged with the engaging portion, wherein at least one of the engaging portion and the engagement portion is made of an elastic material.

7. The strainer according to claim 6, wherein the holding mechanism includes a first step formed inside the operating knob, a cap to which the operating knob is attached, and a second step formed on an upper surface of the cap, the second step being engaged with the first step, wherein the cap is fixed to the upper end of the slider.

8. The strainer according to claim 1, wherein the holder further includes a clamp holder and a clamp cover positioned and configured to hold the snare wires between the clamp cover and the clamp holder, wherein the clamp holder includes a pair of guides that protrude toward the clamp cover and each guide has a threaded hole, wherein the clamp cover includes a pair of guide holes, each guide hole configured to receive one of the guides inserted therein, wherein a bolt is inserted in each guide hole, and wherein the clamp cover is fixed to the clamp holder by fastening each bolt to the threaded hole of the corresponding guide.

9. A snare drum comprising:

a cylindrical shell;

a pair of drumheads each attached to one of the upper and lower opening ends of the shell;

snare wires provided in a stretched state along the lower drumhead of the pair of drumheads; and a strainer that is attached to an outer circumference of the shell and positioned and configured to switch a position of the snare wires between an OFF position separated from the drumhead and an ON position contacting the drumhead, wherein the strainer includes:

a strainer body attached to the shell of the snare drum;

a slider supported to the strainer so as to be slidable;

a cam follower fixed to the slider;

a holder provided on the slider and positioned and configured to affix the snare wires;

an operating lever positioned and configured to be operated so as to switch the position of the snare wires; and a cam pivotably supported on the strainer body and including a cam surface contacting the cam follower, the cam being positioned and configured to be pivoted by operation of the operating lever, wherein the slider is slid relative to the strainer body by the pivoting of the cam caused by operation of the operating lever so that the cam follower moves along the cam surface, wherein the cam surface extends spirally about a pivot center of the cam, and wherein a movement distance of the slider changes linearly with respect to an operation angle of the operating lever.

10. A strainer for a snare drum having a shell, the strainer switching a position of snare wires between an OFF position separated from a drumhead and an ON position contacting the drumhead, the strainer comprising:

a strainer body attached to the shell of the snare drum;

a slider supported to the strainer body so as to be slidable;

a cam follower fixed to the slider;

a holder provided on the slider and positioned and configured to affix the snare wires;

an operating lever positioned and configured to be operated so as to switch the position of the snare wires;

a cam pivotably supported on the strainer body and including a cam surface contacting the cam follower, the cam being positioned and configured to be pivoted by operation of the operating lever;

a position adjustment mechanism including an operating knob for adjusting the position of the snare wires in an up-down direction when the snare wires are at the ON position; and a holding mechanism for maintaining the position of the snare wires in the up-down direction, wherein the holding mechanism includes a first step formed inside the operating knob and a second step formed on an upper surface of a cap to which the operating knob is attached, the second step being engaged with the first step, wherein the cap is fixed to the upper end of the slider, wherein the cam surface extends spirally about a pivot center of the cam, wherein the slider is slid relative to the strainer body by the pivoting of the cam caused by operation of the operating lever so that the cam follower moves along the cam surface, and wherein a movement distance of the slider changes linearly with respect to an operation angle of the operating lever.

* * * * *